US006327862B1

(12) United States Patent
Hanes

(10) Patent No.: US 6,327,862 B1
(45) Date of Patent: Dec. 11, 2001

(54) STIRLING CYCLE CRYOCOOLER WITH OPTIMIZED COLD END DESIGN

(75) Inventor: Mark Hanes, Goleta, CA (US)

(73) Assignee: Superconductor Technologies, Inc., Santa Barbara, CA (US)

( * ) Notice: Subject to any disclaimer, the term of this patent is extended or adjusted under 35 U.S.C. 154(b) by 0 days.

(21) Appl. No.: 09/558,879

(22) Filed: Apr. 26, 2000

(51) Int. Cl.[7] ..... F25B 9/00
(52) U.S. Cl. ..... 62/6; 62/51.2
(58) Field of Search ..... 62/6, 51.2

(56) References Cited

U.S. PATENT DOCUMENTS 3,273,356 * 9/1966 Hoffman ..... 62/51.2
3,282,064 * 11/1966 Cowans et al. ..... 62/6
3,991,585 * 11/1976 Mulder ..... 62/6
4,078,389 * 3/1978 Bamberg ..... 62/6
4,359,872 * 11/1982 Goldowsky ..... 62/6
4,846,861 * 7/1989 Berry et al. ..... 62/6

* cited by examiner

*Primary Examiner*—Ronald Capossela
(74) *Attorney, Agent, or Firm*—Lyon & Lyon LLP

(57) ABSTRACT

A Stirling cycle cryocooler is disclosed that includes a displacer unit having a cold end and a hot end. The displacer unit includes a cold cylinder housing and a displacer liner disposed on the inner surface of the housing. A displacer assembly lies within the displacer liner and is slidable with respect to the lengthwise axis of the housing. The displacer unit also includes a regenerator unit. A heat acceptor is affixed to the cold end of the displacer unit. The heat acceptor transfers heat from a device such as a High Temperature Superconducting Filter to a gas such as helium located within the displacer unit. The heat acceptor preferably includes a radial component and an annular component. The heat acceptor advantageously decreases the heat transfer resistance between the heat acceptor and the helium gas. The Stirling cycle cryocooler is thus able to operate with reduced input power to achieve a desired lift level.

15 Claims, 2 Drawing Sheets

STIRLING CYCLE CRYOCOOLER WITH OPTIMIZED COLD END DESIGN

FIELD OF THE INVENTION

The field of the invention relates generally to cryocoolers. More particularly, the field of the invention relates to Stirling cycle cryocoolers.

BACKGROUND OF THE INVENTION

Recently, substantial attention has been directed to the field of superconductors and to systems and methods for using such products. Substantial attention also has been directed to systems and methods for providing a cold environment (e.g., 77° K. or lower) within which superconductor products such as superconducting filter systems may function.

One device that has been widely used to produce a cold environment within which superconductor devices may function is the Stirling cycle refrigeration unit or Stirling cycle cryocooler. Such units typically comprise a displacer assembly and a compressor assembly, wherein the two assemblies are in fluid communication and are driven by one or more linear or rotary motors. Conventional displacer assemblies generally have a "cold" end and a "hot" end, the hot end being in fluid communication with the compressor assembly. Displacer assemblies generally include a displacer having a regenerator mounted therein for displacing a fluid, such as helium, from one end, i.e., the cold end of the displacer assembly, to the other end, i.e., the hot end, of the displacer assembly. The piston assembly functions to apply additional pressure to the fluid, when the fluid is located substantially within the hot end of the displacer assembly, and to relieve pressure from the fluid, when the fluid is located substantially within the cold end of the displacer assembly. In this fashion, the cold end of the displacer assembly may be maintained, for example, at 77° K., while the hot end of the displacer assembly is maintained, for example, at 15° K. above ambient temperature. Devices such as superconducting filter systems are then typically placed in thermal contact with the cold end of the displacer assembly.

Current Stirling cycle cryocooler designs employ a heat acceptor positioned at the cold end of the displacer assembly. The heat acceptor is typically in thermal contact with the device that is to be cooled, such as a High Temperature Superconducting Filter (HTSF) system. Heat is transferred from the device and to the heat acceptor. The heat transferred to the heat acceptor then passes to the helium gas contained in the displace assembly. The transfer of heat from the heat acceptor to the helium gas typically is the most difficult since the resistance to heat transfer is greatest in this step.

In current cryocooler designs, the ineffective transfer of heat from the heat acceptor to the helium gas results in additional power requirements. In essence, a greater amount of input power is needed to achieve the desired refrigeration lift. The lower heat transfer rate is due, in large part, to the relatively small surface area and low convective heat transfer coefficient.

There is a need for a cryocooler design that decreases the heat transfer resistance between the heat acceptor and the helium gas. The cryocooler design would advantageously require less input power to provide an equivalent amount of refrigeration as compared to prior designs.

SUMMARY OF THE INVENTION

In a first aspect of the invention, a displacer unit for use in a Stirling cycle cryocooler is disclosed. The displacer includes a housing, a displacer liner adjacent to the inside of the housing, a displacer assembly, a regenerator unit, and a heat acceptor. The displacer assembly is located inside the displacer liner and is axially slidable with respect to the housing. The heat acceptor includes a radial component and an annular component. The heat acceptor is affixed to the cold end of the displacer unit.

In a second separate aspect of the invention, a heat acceptor for use on the cold end of a displacer unit is disclosed. The heat acceptor includes a radial component including a radially located inner face that is perpendicular to the long axis of the displacer unit. In addition, the heat acceptor includes an annular component including an inner circumferential face.

In a third aspect of the invention, the displacer unit according the first aspect of the invention further includes a plurality of radial holes in the displacer assembly.

DETAILED DESCRIPTION OF THE PREFERRED EMBODIMENTS

Figure 1:
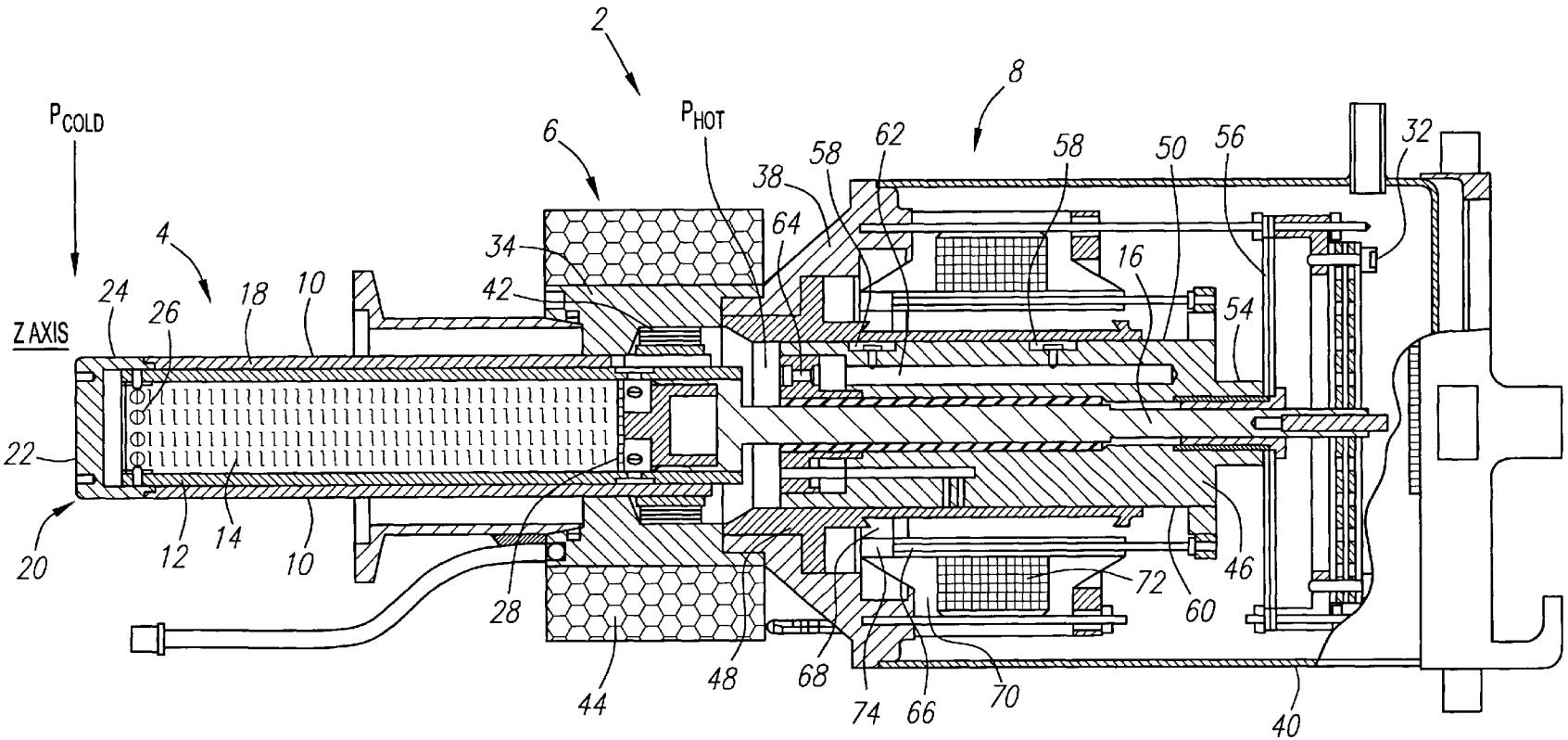
FIG. 1 shows a side view of the Stirling cycle cryocooler.

FIG. 1 illustrates a Stirling cycle cryocooler 2 in accordance with a preferred form of the present invention. As seen in FIG. 1, the Stirling cycle cryocooler 2 preferably includes a displacer unit 4, a heat exchanger unit 6, a compressor and a linear motor assembly 8.

The displacer unit 4 preferably includes a cold cylinder housing 10, a displacer assembly 12, a regenerator unit 14, and a displacer rod assembly 16. A displacer liner 18 is positioned circumferentially about the displacer assembly 12 and inward of the cold cylinder housing 10. The displacer assembly 12 is slidably mounted in the axial direction within the cold cylinder housing 10. Preferably, the displacer liner 18 is affixed to the inner surface of the cold cylinder housing 10.

Figure 2:
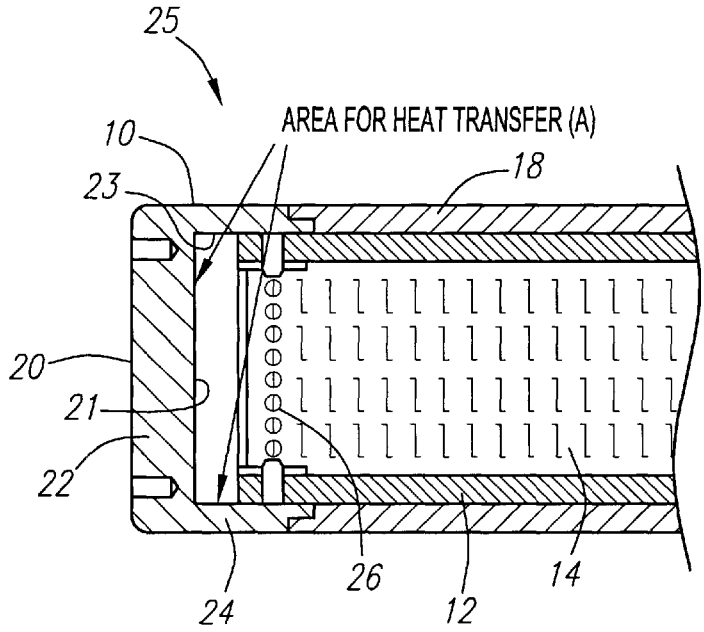
FIG. 2 shows an enlarged side view of the cold end of the displacer unit.

The displacer unit 4 also includes a heat acceptor 20. Preferably, as shown in FIGS. 1 and 2, the heat acceptor 20 includes a radial component 22 and an annular component 24. The radial component 22 is generally perpendicular to the long axis of the displacer unit 4. The long axis lies between the hot and cold ends of the displacer unit 4. The annular component 24 lies along a circumferential annulus of the displacer unit 4. Preferably, the annular component 24 extends from the radial component 22 to beyond the edge of the displacer assembly 12. Even more preferably, the annular component 24 extends axially beyond the edge of the displacer assembly 12 and abuts against a distal end of the displacer liner 18. The heat acceptor 20 is preferably brazed to the cold cylinder housing 10 to provide a hermetically sealed environment. The annular component 24 opposes, in a co-axial-type manner with the displacer liner 18. In this regard, the total area of the heat acceptor 20 available for heat transfer is increased.

Referring now to FIG. 2, the radial component 22 of the heat acceptor 20 includes a radially located inner face 21. The radially located inner face 21 is preferably perpendicular to the long axis of the displacer unit 4. The annular component 24 includes an inner circumferential face 23.

While the heat acceptor 20 has been described as containing two separate components, i.e., a radial component 22 and an annular component 24, it should be understood that the heat acceptor 20 can be a single unitary component. Preferably, the heat acceptor 20 is made of thermally conductive metal such as copper. Even more preferably, the heat acceptor 20 is made from high purity copper or oxygen-free-high-conductivity (OFHC) copper.

In one aspect of the invention, the displacer assembly 12 includes a plurality of radial holes 26. The radial holes 26 permits additional flow of helium within the cold end 25 of the displacer unit 4. The helium flowing through the holes 26 will impinge directly on the heat acceptor 20. The area available for heat transfer, shown by arrow A in FIG. 2, is thus increased. The radial holes 26 assist in decreasing the convective resistance between the heat acceptor 20 and the helium gas within the cryocooler 2.

Still referring to FIG. 1, the displacer rod assembly 16 is coupled at one end to a base section 28 of the displacer assembly 12 and coupled at the other end to a displacer spring assembly 32.

The heat exchanger unit 6, which is located between the displacer unit 4 and the compressor and linear motor assembly 8, preferably includes a heat exchanger block 34, a flow diverter or equivalent structure, and a heat exchanger mounting flange 38. The heat exchanger mounting flange 38 preferably is coupled to a distal end of a pressure housing 40 of the compressor and linear motor assembly 8. The heat exchanger block 34 preferably includes a plurality of internal heat exchanger fins 42 and a plurality of external heat rejector fins 44. Thus, the heat exchanger unit 6 is designed to facilitate heat dissipation from a gas, such as helium, that is compressed in the region $P_{HOT}$ located at the juncture between the displacer unit 4 and the compressor and linear motor assembly 8 (the region $P_{HOT}$ also is referred to herein as the compression chamber of the compressor and linear motor assembly 8). Preferably, the heat exchanger block 34, internal heat exchanger fins 42 and external heat rejector fins 44 are made from a thermally conductive metal such as high purity copper.

The compressor and linear motor assembly 8 preferably includes a pressure housing 40 that has a piston assembly 46 mounted therein. The piston assembly 46 includes a cylinder 48, a piston 50, a piston assembly mounting bracket 54 and a spring assembly 56. The piston assembly mounting bracket 54 provides a coupling between the piston 50 and the spring assembly 56. The piston 50 is thus adapted for reciprocating motion within the cylinder 48. A plurality of gas bearings 58 are provided within the exterior wall 60 of the piston 50, and the gas bearings 58 receive gas, e.g., helium, from a sealed cavity 62 that is provided within the piston 50. A check valve 64 provides a unidirectional fluid communication conduit between the sealed cavity 62 and the region $P_{HOT}$ of the cylinder 48 (i.e., the compression chamber of the cylinder 48) when the pressure of the gas within that region exceeds the pressure within the cavity 62 (i.e., exceeds the piston reservoir pressure).

The piston 50 preferably has mounted thereon a plurality of magnets 66. Internal laminations 68 are secured to the outside of the cylinder 48. External laminations 70 are secured within the pressure housing 40 and are located outward of the magnets 66. The external laminations 70 are preferably secured to a mounting flange 38. The internal and external laminations 68, 70 are preferably made of an iron-containing material. A motor coil 72 preferably lies within the external laminations 70 and surrounds the piston 50. The motor coil 72 is preferably located outward of the magnets 66 and within recesses formed within the external laminations 70. Thus, it will be appreciated that, as the piston 50 moves within the cylinder 48, the magnets 66 move within a gap 74.

During operation, the piston 50 and displacer assembly 12 preferably oscillate at a resonant frequency of approximately 60 Hz and in such a manner that the oscillation of the displacer assembly 12 is approximately 90° out of phase with the oscillation of the piston 50. Stated somewhat differently, it is preferred that the motion of the displacer assembly 12 will "lead" the motion of the piston 50 by approximately 90°.

Those skilled in the art will appreciate that, when the displacer assembly 12 moves to the "cold" end $P_{COLD}$ of the displacer housing 10, most of the fluid, e.g. helium, within the system is displaced to the warm end $P_{HOT}$ of the displacer housing 10 and/or moves around the flow diverter or similar device and through the internal heat exchanger fins 42 into the compression area $P_{HOT}$ of piston assembly 46. Due to the phase difference between the motion of the displacer assembly 12 and the piston 50, the piston 50 should be at mid-stroke and moving in a direction toward the heat acceptor 20 when displacer assembly 12 is located at the cold end of the displacer housing 10. This causes the helium in the areas $P_{HOT}$ to be compressed, thus raising the temperature of the helium. The heat of compression is transferred from the compressed helium to the internal heat exchanger fins 42 and from there to the heat exchanger block 34 and external heat rejector fins 44. From the heat rejector fins 44, the heat is transferred to ambient air. As the displacer assembly 12 moves to the warm end $P_{HOT}$ of the displacer housing 10, the helium is displaced to the cold end $P_{COLD}$ of the displacer housing 10. As the helium passes through the displacer cylinder 12, it deposits heat within the regenerator unit 14, and exits into the cold end $P_{COLD}$ of the displacer housing 10 at approximately 77° K. At this time, the compressor piston 50 preferably is at mid-stroke and moving in the direction of the spring assembly 56. This causes the helium in the cold end $P_{COLD}$ of the displacer housing 10 to expand further reducing the temperature of the helium and allowing the helium to absorb heat. In this fashion, the cold end $P_{COLD}$ functions as a refrigeration unit and may act as a "cold" source.

By using the heat acceptor 20 with the radial component 22 and the annular component 24, the lift of the Stirling cycle cryocooler 2 can be increased for any given input power. Generally, during operation of the Stirling cycle cryocooler 2, helium gas expands at the cold end of the displacer unit 4, which reduces the temperature of the helium gas, and thus reduces the temperature of the heat acceptor 20. The temperature gradient in heat acceptor 20 and helium gas causes heat to flow from the device being refrigerated, such as a High Temperature Superconducting Filter (HTSF), to the heat acceptor 20 and helium gas. The heat transfer rate is a function of the temperature difference between the device being refrigerated and the temperature of the heat acceptor 20 and helium gas, the interface resistance between the device being refrigerated and the heat acceptor 20, the conductive resistance of the heat acceptor 20, and the convective resistance between the heat acceptor 20 and the helium gas inside the Stirling cycle cryocooler 2.

In actual use, the greatest resistance to heat transfer occurs between the heat acceptor 20 and helium gas. The equation which defines this convective resistance is as follows:

(1) $Q=h*A*\Delta T$ where Q=heat transfer rate (watts)

h=convective heat transfer coefficient (watt/° C. $m^2$

A=heat transfer area ($m^2$), and $\Delta T$=temperature difference (°C.).

The Stirling cycle cryocooler 2 reduces the convective resistance by use of the heat acceptor 20. The heat acceptor

20 accomplishes this by increasing the heat transfer area (A), and increasing the convective heat transfer coefficient (h). In addition, the radial holes 26 aid in increasing the convective heat transfer coefficient (h) between the helium gas and the annular portion 24 of the heat acceptor 20. By decreasing the overall convective heat resistance, the Stirling cycle cryocooler 2 requires less input power for the same amount of refrigeration.

Figure 3:
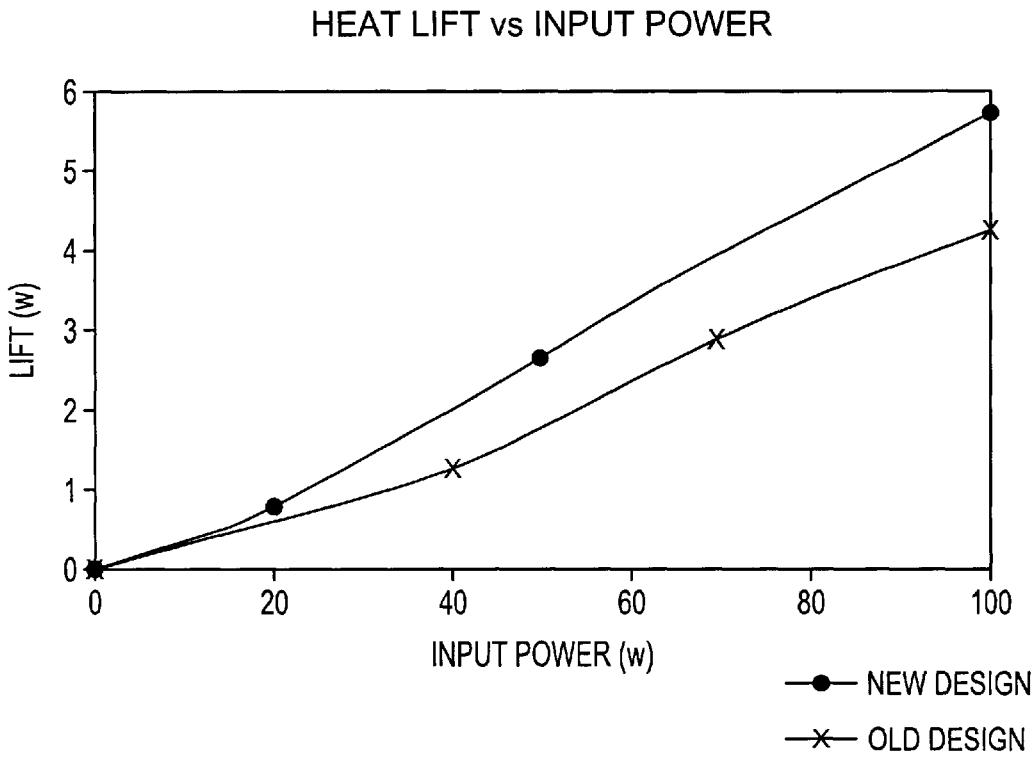
FIG. 3 shows a graph illustrating the heat lift vs. input power for the present cryocooler and the conventional cryocooler.

FIG. 3 illustrates the improved performance of the Stirling cycle cryocooler 2 using the modified heat acceptor 20. As seen from FIG. 3, at 100 watts input power, the lift has increased from 4.25 watts to 5.7 watts, an improvement of about 34%. Consequently, a desired amount of lift can be achieved with reduced input power.

While embodiments of the present invention have been shown and described, various modifications may be made without departing from the scope of the present invention. The invention, therefore, should not be limited, except to the following claims, and their equivalents.

What is claimed is:

1. A displacer unit for use in a Stirling cycle cryocooler the displacer unit comprising:

a housing, the housing having a cold end and a hot end;

a displacer liner adjacent to the inside of the housing;

a displacer assembly located inside the displacer liner, the displacer assembly being axially slidable with respect to the housing, the displacer assembly containing a regenerator unit therein and a plurality of radial holes located in a cold end of the displacer assembly; and a heat acceptor affixed to the cold end of the housing, the heat acceptor including a radial component and an annular component, the annular component extending perpendicular from the radial component, the annular component abutting against the cold end of the housing.

2. A displacer unit according to claim 1, wherein the plurality of radial holes in the displacer assembly are adjacent to the annular component of the heat acceptor.

3. A displacer unit according to claim 1, wherein the annular component of the heat acceptor and the radial component of the heat acceptor are formed of a single heat acceptor.

4. A displacer unit according to claim 1, the heat acceptor formed of a thermally conductive metal.

5. A displacer unit according to claim 4, wherein the heat acceptor is made from copper.

6. A displacer unit according to claim 5, wherein the heat acceptor is made from OFHC copper.

7. A displacer unit according to claim 1, the displacer unit coupled to a heat exchange unit and a compressor and linear motor assembly.

8. A displacer unit according to claim 1, wherein the heat acceptor is brazed to the housing to provide a hermetically sealed environment.

9. A Stirling cycle cryocooler comprising:

a pressure housing having a piston assembly mounted therein, said piston assembly including a piston adapted for reciprocating motion within a cylinder;

a displacer rod assembly being connected at a first end thereof to the piston; and a displacer unit coupled to the Stirling cycle cryocooler, the displacer unit comprising:

a cold cylinder housing having a cold end and a hot end;

a displacer liner disposed inside the housing;

a reciprocating displacer assembly located inside the displacer liner, one end of the displacer assembly being connected to a second end of the displacer rod assembly, the displacer assembly being axially slidable within the cold cylinder housing, the displacer assembly further including a gas regenerator unit therein and a plurality of radial holes located in a cold end of the displacer assembly;

a heat acceptor affixed to the cold end of the cold cylinder housing, the heat acceptor having a radial component and an annular component, the annular component extending perpendicular from the radial component and abutting against the cold end of the cold cylinder housing.

10. An apparatus according to claim 9, wherein the annular component of the heat acceptor and the radial component of the heat acceptor are formed of a single heat acceptor.

11. An apparatus according to claim 9, the heat acceptor being formed of a thermally conductive metal.

12. An apparatus according to claim 11, wherein the heat acceptor is made from copper.

13. An apparatus according to claim 12, wherein the heat acceptor is made from OFHC copper.

14. An apparatus according to claim 9, wherein the plurality of radial holes in the reciprocating displacer assembly are located adjacent to an inner surface of the annular component of the heat acceptor during a portion of the reciprocating motion of the displacer assembly.

15. A displacer unit for use in a Stirling cycle cryocooler, the displacer unit comprising:

a housing, the housing having a cold end and a hot end;

a displacer liner adjacent to the inside of the housing;

a reciprocating displacer assembly having a cold end and a hot end located inside the displacer liner, the displacer assembly being axially slidable with respect to the housing, the displacer assembly further including a plurality of radial holes in the cold end thereof, the displacer assembly also containing a gas regenerator therein;

a heat acceptor affixed to the cold end of the housing, the heat acceptor including a radial component and an annular component; and wherein the plurality of radial holes in the reciprocating displacer assembly are located adjacent to an inner surface of the annular component of the heat acceptor during a portion of the reciprocating motion of the displacer assembly.

* * * * *

UNITED STATES PATENT AND TRADEMARK OFFICE

CERTIFICATE OF CORRECTION

PATENT NO. : 6,327,862 B1
DATED : December 11, 2001
INVENTOR(S) : Hanes

It is certified that error appears in the above-identified patent and that said Letters Patent is hereby corrected as shown below:

Column 4,
Line 63, please change "(watt/° C. $m^2$" to -- (watt/° C $m^2$) --.
Line 66, please change "C." to -- C --.

Signed and Sealed this

Twenty-ninth Day of October, 2002

*Attest:*

*Attesting Officer*

JAMES E. ROGAN
*Director of the United States Patent and Trademark Office*